US006119644A

United States Patent [19]

Speil

[11] Patent Number: 6,119,644

[45] Date of Patent: Sep. 19, 2000

[54] HYDRAULIC CLEARANCE COMPENSATION ELEMENT

[75] Inventor: Walter Speil, Ingolstadt, Germany

[73] Assignee: Ina Wälzlager Schaeffler oHG, Herzogenaurch, Germany

[21] Appl. No.: 09/484,004

[22] Filed: Jan. 18, 2000

Related U.S. Application Data

[63] Continuation of application No. 09/227,439, Jan. 11, 1999, abandoned, which is a continuation of application No. PCT/EP97/02611, May 22, 1997.

[51] Int. Cl.[7] ..... F01L 1/24; F01L 1/08

[52] U.S. Cl. ..... 123/90.55; 123/90.19; 123/90.46; 123/90.51

[58] Field of Search ..... 123/90.19, 90.43, 123/90.46, 90.48, 90.49, 90.51, 90.55, 90.57

[56] References Cited

U.S. PATENT DOCUMENTS

| | | | |
|---|---|---|---|
| 2,941,523 | 6/1960 | Bergmann | 123/90.57 |
| 2,942,595 | 6/1960 | Bergmann | 123/90.57 |
| 3,542,001 | 11/1970 | Line | 123/90.43 |
| 3,598,095 | 8/1971 | Ayres | 123/90.35 |
| 4,876,996 | 10/1989 | Mayer et al. | 123/90.51 |
| 4,878,462 | 11/1989 | Kurisu et al. | 123/90.17 |
| 4,909,198 | 3/1990 | Shiraya et al. | 123/90.51 |
| 4,942,854 | 7/1990 | Shirai et al. | 123/90.17 |
| 5,237,967 | 8/1993 | Willermet et al. | 123/90.51 |
| 5,647,310 | 7/1997 | Kimura et al. | 123/90.6 |

FOREIGN PATENT DOCUMENTS

| | | |
|---|---|---|
| 02 81 990 A1 | 9/1988 | European Pat. Off. . |
| 14 25 653 | 1/1969 | Germany . |
| 31 02 497 A1 | 8/1982 | Germany . |
| 37 24 655 | 8/1988 | Germany . |

OTHER PUBLICATIONS

Patent Abstracts of Japan, vol. 008, No. 104 (M–296), May 16, 1984 & JP 59 015614 A (Atsugi Jidoushiya Buhin KK), Jan. 26, 1984.

MTZ Motortechnische Zeitschrift, vol. 41, No. 12, Dec. 1980, Schwäbisch Gmünd, Germany, pp. 539–542, XP002037013 Klaus Daniel: "Hydraulischer Ventilspielausgleich–Aufbau, Funktion, Entwicklungsgrundlagen".

*Primary Examiner*—Weilun Lo
*Attorney, Agent, or Firm*—Henry M. Feiereisen

[57] ABSTRACT

A hydraulic clearance compensation element actuated by a cam of a camshaft and adapted for use with a valve drive, includes a casing closed on one end by a bottom which bears upon one end of a gas exchange valve, a pressure piston so received in the interior of the casing that a leakage gap for hydraulic fluid is formed between an outer surface area of the pressure piston and an adjacent side wall of the casing for enabling the clearance compensating function. The pressure piston and the casing are movable relative to one another in axial direction, with a high pressure chamber being defined between the bottom and a confronting end face of the pressure piston for receiving a hydraulic fluid. In order to provide the leakage gap of optimum size over the entire temperature range adjacent structural components of the pressure piston and the casing in the area of the leakage gap are configured in accordance with the following equation:

$$C = \frac{S[\mu m] * \varepsilon'}{h_R[mm] * d_m[mm]} = 8 \ldots 32.$$

wherein

C is a characteristic ratio number,

S is the width of the leakage gap,

ε' is the quotient of the thermal expansion coefficient $\epsilon_D$ of the pressure piston to the thermal expansion coefficient $\epsilon_G$ of the casing,

14 Claims, 3 Drawing Sheets

HYDRAULIC CLEARANCE COMPENSATION ELEMENT

CROSS-REFERENCES TO RELATED APPLICATIONS

This application is a continuation of prior filed application Ser. No. 09/227,439, filed Jan. 11, 1999 now abandoned, which is a continuation of prior filed copending PCT International application no. PCT/EP97/02611, filed May 22, 1997 which claims the priority of German Patent Application, Ser. No. 196 27 982.8, filed Jul. 11, 1996.

BACKGROUND OF THE INVENTION

The present invention relates, in general, to a valve drive for an internal combustion engine, and more particularly, to a hydraulic clearance compensation element for a valve drive.

German patent publication DE-OS 14 25 653 describes a clearance compensation element for a valve drive of an internal combustion engine, with the clearance compensation element being acted upon by a cam of a camshaft. The clearance compensation element includes a hollow-cylindrical casing which defines an interior bore for accommodating a pressure piston, whereby the casing and the pressure piston are axially movable relative to one another. The bottom of the casing rests upon a gas exchange valve and defines together with a confronting end of the pressure piston a high-pressure chamber for hydraulic fluid. A check valve is positioned at the end face of the pressure piston to regulate a passage to the high-pressure chamber from a reservoir enclosed by the pressure piston. Formed between the bore of the casing and an outer surface area of the pressure piston is a leakage gap for hydraulic fluid, whereby at least in the zone of the leakage gap, the casing has a coefficient of thermal expansion which is smaller than the coefficient of thermal expansion of the pressure piston. A drawback of this conventional valve drive with clearance compensation element is its inability to compensate for rapid dimensional changes in the gas exchange valve, for example, when a large amount of heat is generated following a cold start.

SUMMARY OF THE INVENTION

It is thus an object of the present invention to provide an improved hydraulic clearance compensation element, obviating the afore-stated drawbacks.

In particular, it is an object of the present invention to provide an improved hydraulic clearance compensation element which exhibits a sinking characteristics which has a smallest-possible temperature-dependency and thus viscosity-dependency while still reliably operating during the entire operational phase of the internal combustion engine.

These objects, and others which will become apparent hereinafter, are attained in accordance with the present invention by configuring adjacent structural components of the pressure piston and the casing in the area of the leakage gap in accordance with the following equation:

$$C = \frac{S[\mu\text{m}] * \varepsilon'}{h_R[\text{mm}] * d_m[\text{mm}]} = 8 \ldots 32.$$

wherein

C is a characteristic ratio number,

S is the width of the leakage gap 14, $\epsilon'$ is the quotient of the thermal expansion coefficient $\epsilon_D$ of the pressure piston 5 to the thermal expansion coefficient $\epsilon_G$ of the casing 3, $h_R$ is the height of the closing ramp $B_{2\text{-}4}$ of the cam 12, positioned immediately ahead of the base circle $B_5$ in the direction of rotation, and $d_m$ is the mean diameter of the leakage gap 14.

In accordance with the present invention, the hydraulic clearance compensation element can adapt to a rapid length fluctuation of the gas exchange valve, e.g. following a cold start, and is capable to completely neutralize this change in length. The parameters of the leakage gap can be easily adjusted to provide optimum operating conditions. The gas exchange valve will always seat "softly" when the closing ramp has a defined height. Unlike conventional valves, the leakage gap retains an optimum width over a wide temperature range, thereby preventing the pressure piston and the casing from seizing during operation. Moreover, the clearance compensation element quickly adjusts the sink rate to compensate for the decrease in the clearance between the clearance compensation element and the cam. This feature is particularly important during the start-up phase of the engine when the length of the exhaust valve increases very rapidly. Conventional clearance compensation elements are unable to adapt fast enough to these dimensional changes of the valve.

The present invention reconciles three constraints with respect to configuration of the leakage gap that seem to oppose one another. A first constraint is the phase during the cold start at extremely low temperatures. In this phase, as is generally known, the leakage gap should be sufficiently large to allow passage of highly viscous hydraulic fluid so as to enable a quick reaction by the clearance compensation element in response to the relatively rapid dilatation of the hot exchange valve. A second constraint is determined by the hot running of the engine. In this phase, the leakage gap should be sufficiently large to prevent a seizing between the pressure piston and the casing. The tendency for seizing is based on the more rapid "growth" of the pressure piston relative to the casing as a consequence of their thermal expansion. A third constraint limits the dimension of the leakage gap in those phases when the engine runs hot and the viscosity of the hydraulic fluid is low. In this phase, the leakage gap should be small enough so as to prevent the clearance compensation element from sinking too fast during lift and thus to prevent a premature seating and hard impact of the valve upon the valve seat.

The definition of the characteristic ratio number allows dimensioning of a leakage gap that reconciles the above-stated three constraints. The artisan, aware of the problems in conjunction with optimum dimensioning of the leakage gap has now a formula that allows a sizing of the leakage gap that best suits the situation at hand, by so selecting the width, the ramp height, the mean leakage gap diameter and the quotient of the thermal heat of the thermal expansion coefficient of the pressure piston to the thermal expansion coefficient of the casing, that a characteristic ratio number between 8 and 32 is obtained. Only then will the clearance compensation element display an optimized sink characteristics across all temperature and viscosity ranges, i.e. the clearance compensation element sinks rapidly enough during cold start, does no seize during hot running of the internal combustion engine, and does not rattle as a consequence of a premature seating.

The gas exchange valve also closes properly by eliminating a clearance in the base circle which may otherwise cause the internal combustion engine to run rough or to stop altogether, or to malfunction. Thus, it is possible to provide a more optimal timing adjustment and to realize more uniform cross-sections during entire gas exchange cycle for each valve lift and reduced valve overlaps.

According to another feature of the present invention, the cam, when viewed from a cam nose in the direction of rotation, has a drop cam flank, a closing ramp extending between the drop cam flank and the cam base, with the closing ramp including a first ramp section immediately following the drop cam flank and formed with a degressive profile to operate the gas exchange valve with a closing speed of approximately 40–20 $\mu$m per °NW (degree of cam angle), a second intermediate ramp section following the first ramp section and formed with an approximately linear profile to operate the gas exchange valve with a closing speed of approximately 30–10 $\mu$m per °NW, and a third ramp end section following the second section and formed with a linear or degressive profile to operate the gas exchange valve with a closing speed of approximately 40–0 $\mu$m per °NW. By providing the second intermediate section of the closing ramp at constant speed, the gas exchange valve is statistically expected to seat most frequently. The first section region and the third end section may again have a degressive profile to realize a short closing ramp. Under extreme conditions of the internal combustion engine (e.g., extremely high or low temperatures in the area of the clearance compensation element), the clearance compensation element may seat while in the connecting section or the end section; However, the number of impacts is negligible as far as wear is concerned.

Advantageously, the clearance compensation element maintains a minimum gap of at least 1 $\mu$m even at the highest temperatures.

The entire casing and the entire pressure piston may be fabricated of materials with different thermal expansion characteristics. Alternatively, materials with these characteristics may be employed only in the region of the leakage gap. The casing may also be fabricated of a material which shrinks with increasing temperature, for example, of a material whose lattice structure changes with increasing temperature.

According to another feature of the present invention, one region of the cam closing ramp may have a height of less than 0.4 mm so that the gas exchange valve is expected to seat softly when impacting in this region, thereby eliminating wear and noise problems otherwise encountered to date. An undesirable valve overlap during the engine start-up phase or during the time between engine start and operation under partial load may be eliminated or at least reduced by making the entire closing ramp as short as possible.

The quotient between a thermal expansion coefficient of the pressure piston and the casing may advantageously be between approximately 1.2 and 2. This range provides an optimum match between the materials of the leakage gap.

The closing ramp, i.e. the section located between the drop cam flank and the base circle of the cam, may be designed to transmit a degressive (decreasing) lift to the gas exchange valve. The gas exchange valve is then expected to seat softly while also keeping the total drop ramp region relatively short.

Suitably, the pressure piston may be made of austenitic steel or aluminum, while the casing surrounding the pressure piston may be made of ferritic steel. If the pressure piston is made of aluminum, which is a relatively "soft" material, then the piston may be chemically and/or physically coated with a protective layer to reduce wear.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
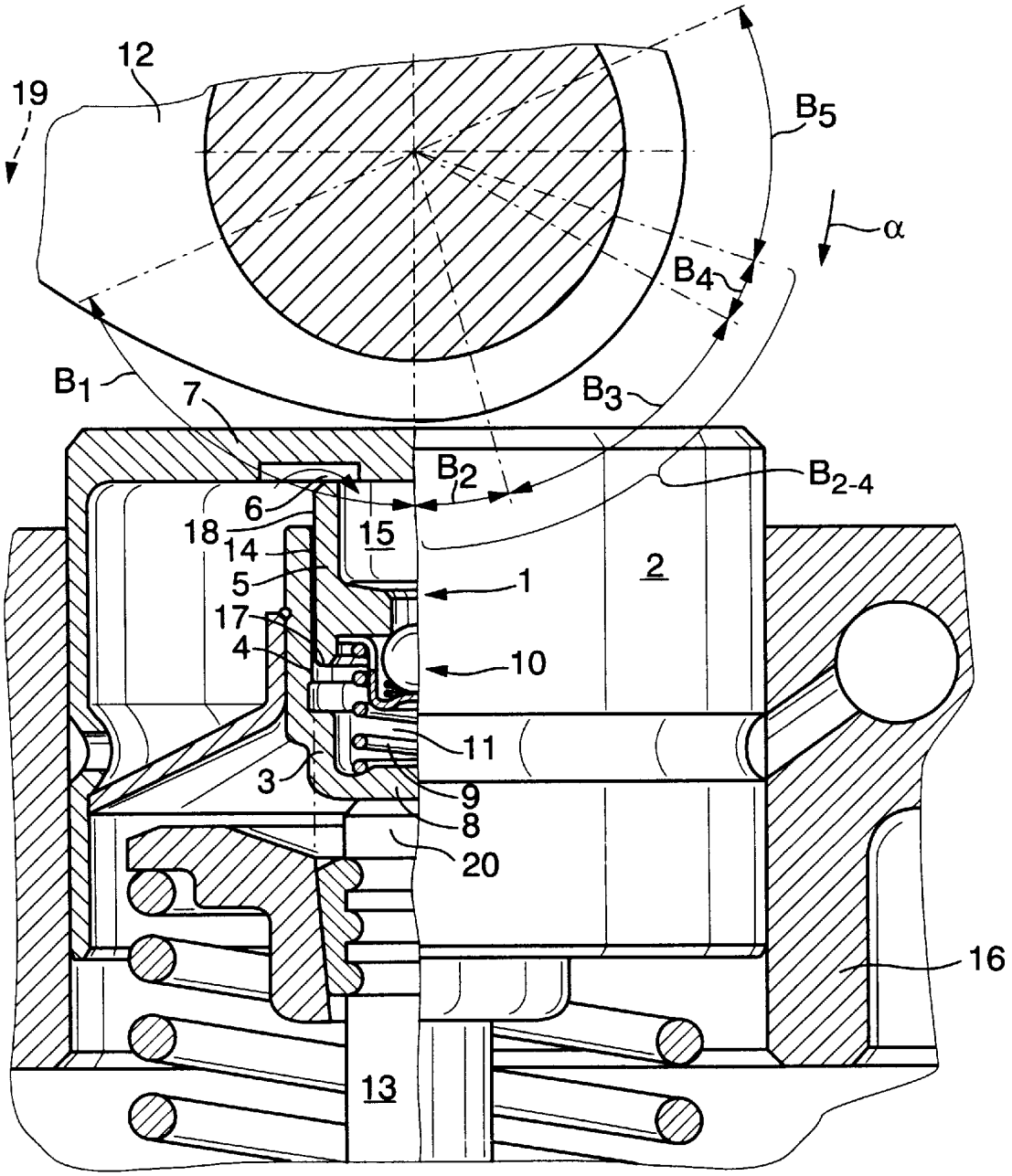
FIG. 1 is a longitudinal section through a valve drive with a clearance compensation element embodying the features of the present invention and interacting with a cam.

Throughout all the Figures, same or corresponding elements are generally indicated by same reference numerals.

Turning now to the drawing, and in particular to FIG. 1, there is shown a valve drive having a hydraulic clearance compensation element 1, which is incorporated into a cup-shaped tappet 2 in a manner known per se. The clearance compensation element 1 includes a casing 3 in the form of a hollow cylinder to define an interior bore 4, and a pressure piston 5 which is received in the bore 4 of the casing 3 and movable relative to the casing 3. The cup-shaped tappet 2 has a bottom 7 to support one end face 6 of the pressure piston 5. In the opposite direction, a bottom 8 of the casing 3 supports the pressure piston 5 via a spring member 9. The pressure piston 5 further includes a check valve 10 that is located in the direction of the casing bottom 8 and opens towards the casing base 8. The operation and structure of the check valve 10 are generally known and thus have not been described in more detail for sake of simplicity. A high-pressure chamber 11 for hydraulic fluid extends axially between the pressure piston 5 and the casing bottom 8. The bottom 7 of the cup-shaped tappet 2 is actuated and lifted by a cam 12, whereby the cup-shaped tappet 2 transfers the lift of the cam 12 to an end 20 of a gas exchange valve 13, for example an exhaust valve, with the end 20 confronting the bottom 8 of the casing 3.

The principal mode of operation of the clearance compensation element 1 installed in the cup-shaped tappet 2 is generally known in the art and will not be described in more detail for sake of simplicity. However, during each lifting motion of the cam 12, a small amount of hydraulic fluid is expelled via a leakage gap 14 extending between the casing 3 and the pressure piston 5. The expulsion of hydraulic fluid results in a sinking of the pressure piston 5 and the casing 3 relative to each other. During a base circle phase $B_5$ of the cam 12, the high pressure space 11 draws a pre-defined amount of hydraulic fluid from a reservoir 15, which is enclosed by the pressure piston 5, thereby eliminating the clearance in the valve drive. At the same time, the spring member 9 realizes a forced engagement between the cup-shaped tappet 2, the cam 12 and the gas exchange valve 13 free of play. The change in length of the clearance compensation element 1 as a consequence of the expulsion of hydraulic fluid from the high-pressure space 11 is not only necessary for compensating the valve clearance, but also for compensating dilatations in the valve drive, e.g., due to wear of the valve seat or thermal expansion, as described above.

The casing 3 is made of a material which has a thermal expansion coefficient that is smaller than the thermal expansion coefficient of the material of the pressure piston 5. Principally, the width of the leakage gap 14 between the casing 3 and the pressure piston 5 decreases with increasing temperature. However, a minimal gap of, for example, at least 1 $\mu$m should be maintained at highest operating temperature. Examples for suitable materials include austenitic steel or aluminum for the pressure piston 5, and ferritic steel for the casing 3.

In the following description, different sections of the cam 12 are designated in the direction of rotation following the cam nose 19. Reference character $B_1$ denotes the immediately following return cam ramp, $B_2$ denotes a connecting section which may have a degressive profile, $B_3$ denotes an intermediate section which is preferably linear (i.e., provides a constant speed), $B_4$ denotes an end section which follows the intermediate section $B_3$ and is preferably degressive, and $B_5$ denotes the base circle of the cam 12. The sections $B_2$–$B_4$ therefore constitute a closing ramp $B_{2\text{-}4}$ which, as a result of the described configurations, can be designed to have a very short optimum length. The gas exchange valve 13 then advantageously seats relatively "softly" in the valve seat (not shown) at all ranges of the operating temperature. Because the closing ramp can be made short, the valve overlap region also becomes shorter, which improves the valve timing characteristics. Persons skilled in the art will understand that it is certainly within the scope of the invention to design the entire closing ramp $B_{2\text{-}4}$ with degressive profile.

Figure 2:
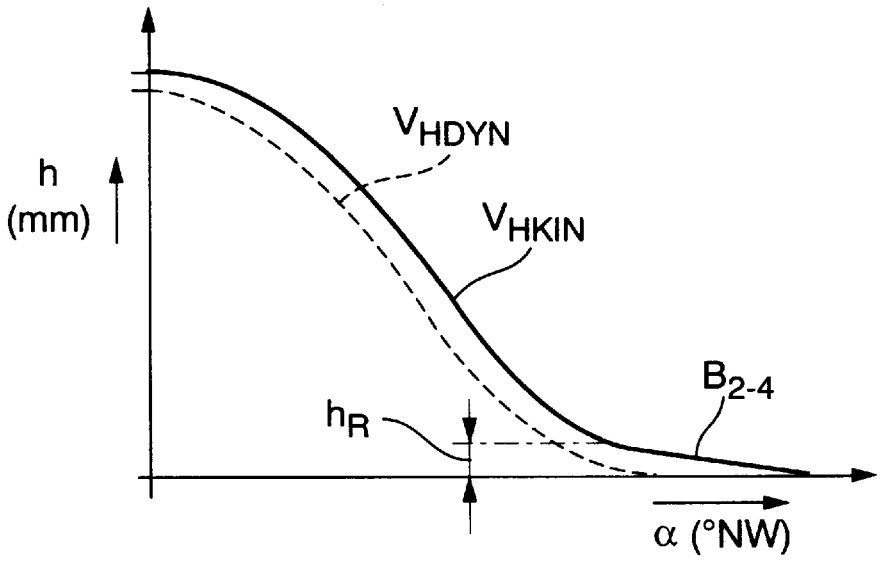
FIG. 2 is a schematic timing diagram of the valve lift during cam actuation.

FIG. 2 illustrates a graphical illustration of a valve lift curve which is known per se. The curve $V_{HDYN}$ is identical to the curve for the kinematic valve lift $V_{HKIN}$, except that the compressibility and elasticity of the entire valve drive has been subtracted as well as the decrease in lift which depends on the operating conditions (temperature and speed) and caused by a sinking of the clearance compensation element 1 when hydraulic fluid is expelled from the high pressure space 11 via the leakage gap 14, as discussed above. As is also shown in FIG. 2, the closing ramp $B_{2\text{-}4}$ has a linear profile, thereby providing a constant speed. Consequently, the gas exchange valve 13 will seat "softly" in this region, reducing wear and noise.

Figure 3:
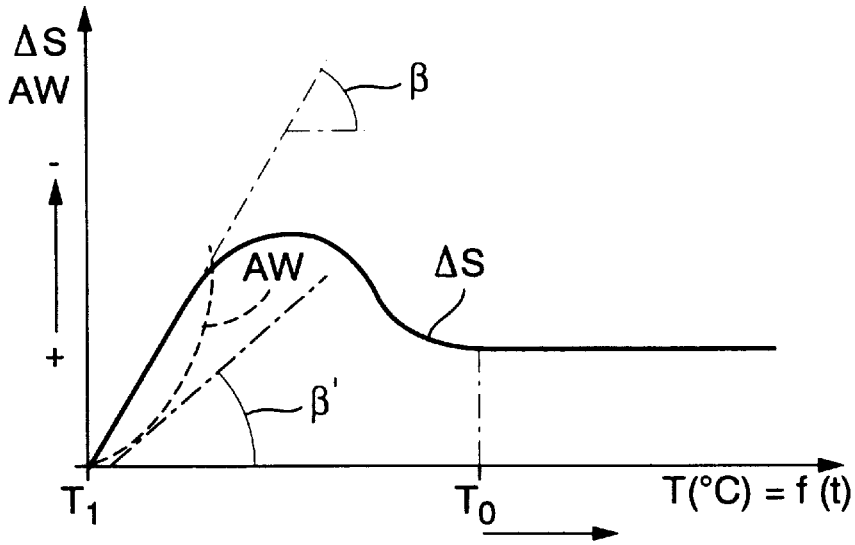
FIG. 3 is a typical graphical illustration of a negative change in clearance of an exhaust valve as a function of time and temperature after the internal combustion engine is started again.

Referring now to FIG. 3, there is shown a typical graphical illustration of a negative change in clearance of an exhaust valve as a function of time and temperature after the internal combustion engine is started again. In particular, FIG. 3 shows a change in the clearance $\Delta S$ of an exhaust valve 13 relative to its surrounding components as a function of time t following a cold start of the internal combustion engine. Current material combinations employed in valve drives and cylinder heads produce a rapid increase in the linear dimensions of the exhaust valve 13 relative to its adjoining components (e.g., the cylinder head 16) immediately after a cold start of the internal combustion engine (gradient $\beta$) , i.e. as a consequence of its exposure to hot gases, the exhaust valve 13 heats up more rapidly than surrounding components and thus considerably lengthens with respect to the surrounding components, such as the clearance compensation element 1. The gradient $\beta'$ in the diagram indicates the total sum of continuously digitally added sink paths of the pressure piston 5 relative to the casing 3 during the warm-up phase i.e. the sink rate AW of the pressure piston 5 relative to the casing 3 is smaller than the lengthening of the valve 13. In order to compensate within a sufficiently short time the negative change in clearance, the gradient $\beta'$ has to be at least the same as the gradient $\beta$, suitably steeper than the gradient $\beta$, as targeted in accordance with the invention. In other words, the sink rate by which the pressure piston sinks relative to the casing after each lift cycle of the cam 12 at least corresponds to or is greater than the change in length of the gas exchange valve 13 during the cold start phase and prevailing temperature differences between the valve and surrounding components. Only then can the gas exchange valve 13 be expected to close fully during the heat-up phase of the internal combustion engine.

In particular, the realization of a gradient $\beta'$ that at least corresponds or is steeper than the gradient $\beta$ can be attained in practice by establishing a characteristic ratio number C which forms a basis for dimensioning the leakage gap 14 at a temperature of 20° C. and is defined as follows:

$$C = \frac{S[\mu\text{m}] * \varepsilon'}{h_R[\text{mm}] * d_m[\text{mm}]} = 8 \ldots 32.$$

wherein

Figure 1A:
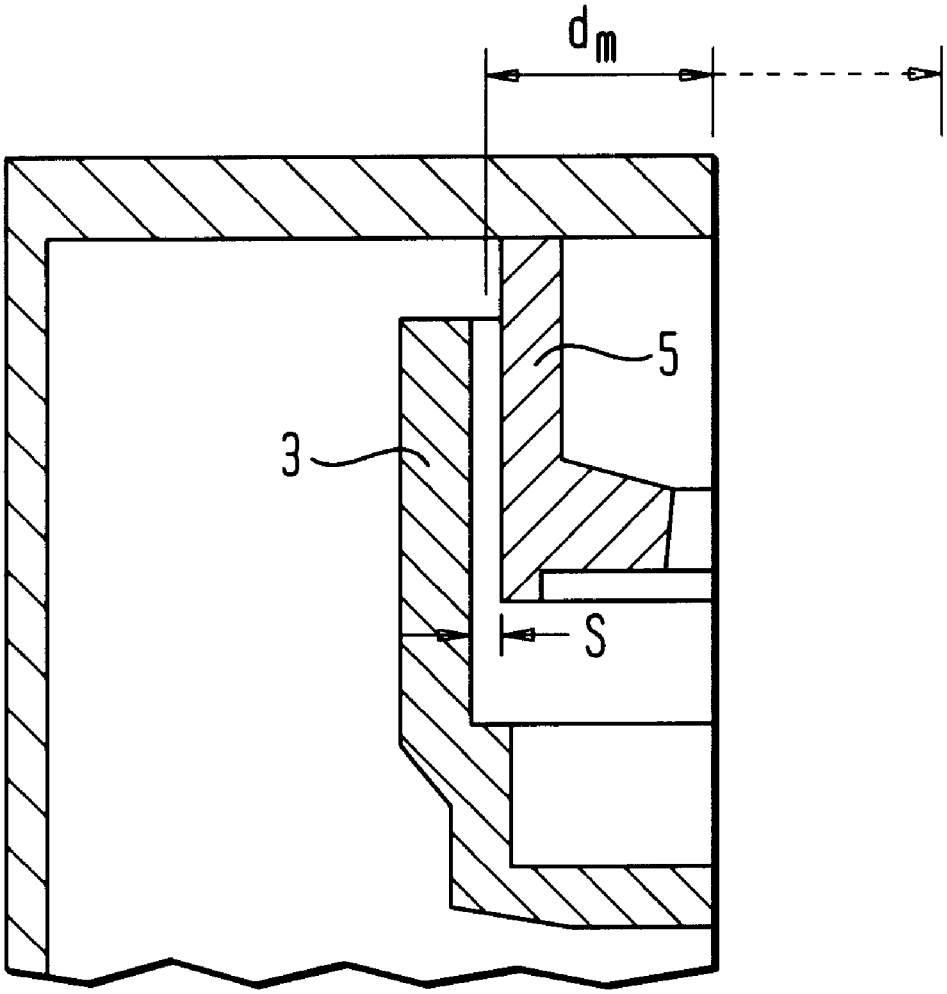
FIG. 1*a* is a cutaway sectional view, on an enlarged scale, of the clearance compensation element in an area of the leakage gap between casing and pressure piston.

S is the width of the leakage gap 14, as indicated in FIG. 1*a*, $\epsilon'$ is the quotient of the thermal expansion coefficient $\epsilon_D$ of the pressure piston 5 to the thermal expansion coefficient $\epsilon_G$ of the casing 3, $h_R$ is the height of the closing ramp $B_{2\text{-}4}$ of the cam 12, positioned immediately ahead of the base circle $B_5$ in the direction of rotation, and $d_m$ is the mean diameter of the leakage gap 14, as indicated in FIG. 1*a*.

By applying the features of the present invention, the stated problems can be solved. The definition of the characteristic ratio number allows calculation of a leakage gap 14 that reconciles the above-stated three limitations in those phase when the valve drive and cylinder head components 16 do not exhibit a uniform thermal expansion relative to each other (a uniform thermal expansion of the valve drive and cylinder head components 16 relative to each other is realized only after the gas exchange valve 13 reaches a constant operating temperature $T_0$). The artisan, aware of the problems in conjunction with the leakage gap 14 can now, based on the above formula, properly size the leakage gap 14 depending on the situation at hand, by so selecting the width, the ramp height, the mean leakage gap diameter and the quotient of the thermal heat of the thermal expansion coefficient of the pressure piston 5 to the thermal expansion coefficient of the casing 3, that a characteristic ratio number C between 8 and 32 is obtained.

While the invention has been illustrated and described as embodied in a valve drive for an internal combustion engine, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A hydraulic clearance compensation element, comprising:

a casing defined by an axis, said casing having an interior and being closed on one end by a bottom which bears upon one end of a gas exchange valve;

a pressure piston so received in the interior of the casing that a leakage gap for hydraulic fluid is formed between an outer surface area of the pressure piston and an adjacent side wall of the casing, said pressure piston and said casing being movable relative to one another in axial direction, with a high pressure chamber being defined between the bottom and a confronting end face of the pressure piston for receiving a hydraulic fluid; and a check valve arranged on the end face of the pressure piston and opening towards the high pressure chamber, said check valve receiving hydraulic fluid from a reservoir enclosed by the pressure piston;

wherein the leakage gap is dimensioned to meet a characteristic ratio (C) between 8 and 32 at a temperature of 20° C. wherein $$C = \frac{S[\mu m] * \varepsilon'}{h_R[mm] * d_m[mm]} = 8 \ldots 32.$$

wherein

C is the characteristic ratio number,

S is the width of the leakage gap, $\epsilon'$ is the quotient of the thermal expansion coefficient $\epsilon_D$ of the pressure piston to the thermal expansion coefficient $\epsilon_G$ of the casing, $h_R$ is the height of a closing ramp of the cam, positioned immediately ahead of a base circle in the direction of rotation, and $d_m$ is the mean diameter of the leakage gap.

2. The clearance compensation element of claim 1 wherein at least in the region of the leakage gap the casing has is made of a material having a thermal expansion coefficient which is smaller than a thermal expansion coefficient of a material of an outer surface area of the pressure piston in communication with the region of the casing.

3. The clearance compensation element of claim 1 wherein the casing and the pressure piston are made of materials exhibiting different thermal expansion coefficients.

4. The clearance compensation element of claim 1 wherein the cam has a drop cam flank, the closing ramp extending between the drop cam flank and the cam base circle, the height ($h_R$) of the closing ramp being less than 0.4 mm.

5. The clearance compensation element of claim 1 wherein the leakage gap is greater than 1 $\mu$m when the clearance compensation element operates at a maximum operating temperature.

6. The clearance compensation element of claim 5 wherein the maximum operating temperature is approximately 160° C.

7. The clearance compensation element of claim 1 wherein the quotient $\epsilon'$ of the thermal expansion coefficient of the pressure piston to the thermal expansion coefficient of the casing is governed by $1.2 \leqq \epsilon' < 2$.

8. The clearance compensation element of claim 4 wherein the closing ramp has a degressive profile to operate the gas exchange valve.

9. The clearance compensation element of claim 4 wherein the closing ramp has a first ramp section immediately following the drop cam flank and formed with a degressive profile to operate the gas exchange valve with a closing speed of approximately 40–20 $\mu$m per degree of cam angle (°NW), a second intermediate ramp section following the first ramp section and formed with an approximately linear profile to operate the gas exchange valve with a closing speed of approximately 30–10 $\mu$m per °NW, and a third ramp end section following the second section and formed with a linear or degressive profile to operate the gas exchange valve with a closing speed of approximately 40–0 $\mu$m per °NW.

10. The clearance compensation element of claim 1 wherein at least in the area of the leakage gap, the pressure piston is made of a material selected from the group consisting of austenitic steel and aluminum, and the casing is made at least in the area of the leakage gap of ferritic steel.

11. The clearance compensation element of claim 1 wherein at least one of the members selected from the group consisting of pressure piston and casing is made in the area of the leakage gap with a wear protection layer.

12. The clearance compensation element of claim 11 wherein the wear protection layer is applied by a process selected from the group consisting of hard-coating, hard chrome plating and nitrogen case hardening.

13. The clearance compensation element of claim 1 wherein the clearance compensation element exhibits such a sinking characteristics as to compensate a change in length of the gas exchange valve during each lifting cycle of the cam, said sinking characteristics being defined during a cold start phase and at temperature differences between the gas exchange valve and a surrounding area thereof by a sink rate of the pressure piston relative to the casing which sink rate at least corresponds to or is greater than a rate of a change in length of the gas exchange valve.

14. The clearance compensation element of claim 1, with the clearance compensation element being installed in a housing of a cup-shaped tappet, said housing having a tappet bottom actuated by a cam of a camshaft, and said pressure piston having another end face bearing upon the tappet bottom.

* * * * *